US007918054B2

(12) United States Patent
Grafton et al.

(10) Patent No.: US 7,918,054 B2
(45) Date of Patent: Apr. 5, 2011

(54) ROOFING BRACKET AND SYSTEM

(75) Inventors: Michael Anthony Grafton, Savannah, GA (US); Ernest Graham Perry, Richmond Hill, GA (US)

(73) Assignee: GP Innovative Concepts, LLC, Savannah, GA (US)

( * ) Notice: Subject to any disclaimer, the term of this patent is extended or adjusted under 35 U.S.C. 154(b) by 188 days.

(21) Appl. No.: 12/075,158

(22) Filed: Mar. 8, 2008

(65) Prior Publication Data

US 2009/0211177 A1 Aug. 27, 2009

Related U.S. Application Data

(60) Provisional application No. 61/031,299, filed on Feb. 25, 2008.

(51) Int. Cl.
*E04B 7/04* (2006.01)

(52) U.S. Cl. ..... 52/92.3; 52/92.2; 52/640; 52/713; 52/655.1; 52/105; 248/291.1; 248/324; 248/300; 403/4; 403/27; 403/85

(58) Field of Classification Search ..... 52/92.1, 52/92.2, 92.3, 93.1, 640, 641, 713, 714, 655.1, 52/105, 712; 248/291.1, 324, 300; 403/4, 403/DIG. 15, 27, 85, 60
See application file for complete search history.

(56) References Cited

U.S. PATENT DOCUMENTS 1,787,167 A * 12/1930 Purdy ..... 403/58
2,229,869 A * 1/1941 Koch ..... 52/699
3,167,285 A * 1/1965 Suozzo ..... 248/543
3,289,362 A * 12/1966 Whelan ..... 52/92.2
3,423,898 A * 1/1969 Coloney et al. ..... 52/713
3,596,941 A * 8/1971 Tracy ..... 403/27
3,648,426 A * 3/1972 Chaudhary ..... 52/633
3,749,428 A * 7/1973 Hustead ..... 403/91
3,785,108 A * 1/1974 Satchell ..... 52/645
3,849,961 A * 11/1974 Gwynne ..... 52/639
4,148,164 A * 4/1979 Humphrey ..... 52/94
4,410,294 A * 10/1983 Gilb et al. ..... 403/27
4,449,335 A * 5/1984 Fahey ..... 52/92.2

(Continued)

FOREIGN PATENT DOCUMENTS

EP 357273 A1 * 3/1990

*Primary Examiner* — Robert J Canfield
*Assistant Examiner* — Matthew J Gitlin
(74) *Attorney, Agent, or Firm* — Christopher Smyth

(57) ABSTRACT

Various novel roofing brackets and roofing systems are disclosed. A first embodiment can be considered a roofing bracket to be coupled to a vertical post and a horizontal purlin of a roofing system whereby the horizontal purlin is positioned to support roof panels at a requisite pitch. The roofing bracket includes a reference brace and a clip. The reference brace includes a first brace face positioned planarly parallel with the vertical post and a second brace face extending at an angle angle from the first brace face and positioned planarly parallel with the vertical post. The clip includes a first clip face positioned to be fastened generally flush with the horizontal purlin and a second clip face extending at an angle from the first clip face and positioned to be fastened planarly parallel with the vertical post. The second clip face is coupled to the first brace face at a pivot point such that the clip can be rotated a particular angle relative to the reference brace. The angle of rotation is consistent with the requisite pitch of the roofing system.

16 Claims, 8 Drawing Sheets

U.S. PATENT DOCUMENTS 4,631,880 A * 12/1986 Leicht ..... 52/105
4,796,403 A * 1/1989 Fulton et al. ..... 52/713
4,841,690 A * 6/1989 Commins ..... 52/105
4,924,644 A * 5/1990 Lewis ..... 52/105
5,094,059 A * 3/1992 Ganescu ..... 52/641
5,230,198 A * 7/1993 Callies ..... 52/702
5,335,469 A * 8/1994 Stuart ..... 52/655.1
5,553,961 A * 9/1996 Olden ..... 403/119
5,720,571 A * 2/1998 Frobosilo et al. ..... 403/403
5,797,694 A * 8/1998 Breivik ..... 403/231
5,846,018 A * 12/1998 Frobosilo et al. ..... 403/403
5,857,295 A * 1/1999 Mikawa ..... 52/92.2
5,983,577 A * 11/1999 Hays ..... 52/79.1
6,047,513 A * 4/2000 Gibson ..... 52/646
6,213,679 B1 * 4/2001 Frobosilo et al. ..... 403/403
6,240,682 B1 * 6/2001 James et al. ..... 52/90.2
6,298,630 B1 * 10/2001 VeRost et al. ..... 52/712
6,324,810 B1 * 12/2001 Thompson ..... 52/713
6,357,712 B1 * 3/2002 Lu ..... 248/291.1
6,470,644 B2 * 10/2002 James et al. ..... 52/745.06
6,758,016 B2 * 7/2004 Gobeil ..... 52/191
6,772,570 B2 * 8/2004 Horne ..... 52/655.1
2001/0025458 A1 * 10/2001 James et al. ..... 52/90.2
2004/0216316 A1 * 11/2004 Ellis et al. ..... 33/471
2006/0059794 A1 * 3/2006 Gilstrap et al. ..... 52/90.1

* cited by examiner

ROOFING BRACKET AND SYSTEM

CROSS-REFERENCE TO RELATED APPLICATIONS

This application claims the benefit of U.S. Provisional Application, Application No. 61/031,299, filed on Feb. 25, 2008, and entitled "Framing Bracket," which is incorporated by reference herein in its entirety.

FIELD OF THE INVENTION

The present invention relates to roofing systems, and more specifically, relates to roofing brackets.

BACKGROUND SECTION

Roofing structures can be constructed using a number of different methods and roofing systems. One common system, commonly used for retrofit roofs, is the post and purlin system. The post and purlin system includes a plurality of elongated vertical support posts fastened to the existing roof substrate. A network of base beams fastened atop and flush to the existing roof substrate may be used to strengthen the web of posts. The vertical posts may be fastened directly to the roof substrate or to the base beams fastened to the substrate.

Fastened to an upper end of the vertical posts are horizontal purlins that run perpendicular to the vertical posts in the horizontal plane. The height of the horizontal plane varies at each intersection based upon the pitch or slope of the roof. For example, a horizontal purlin may intersect with a vertical post at 10' relative to the roof substrate at the eave of the roof, and at 16' at the ridge. Posts and purlins may be found at locations intermediate the eaves and ridge of the roof Importantly, the post length and positioning of the purlins about the posts must be consistent with the desired pitch of the roof.

Zee-shaped purlins ("zee purlins") are commonly used in roofing systems. These purlins get their name from their similarity in shape to the letter Z. Zee purlins are comprised of three faces, a top face (generally horizontal), a vertical face, and a bottom face (generally horizontal), shaped to form a generally Z-shaped device. A straight zee purlin is one with the faces meeting at roughly 90°.

Mounted atop the purlins may be any variety of roofing panels with or without intermediate insulating material. The roofing panels are designed to mount relatively flush to the top faces of the network of horizontal purlins.

Brackets are used for fastening the vertical posts to the purlins and brackets may be used for fastening the vertical posts to the roof substrate. Workers place brackets in desired positions and drive fasteners through a bracket and into the vertical posts, the vertical faces of the purlins, or the roof substrate.

In some instances, the desired pitch is accounted for in the shape of the horizontal purlin. Here a straight zee purlin may be bent such that the top face meets the vertical face at an angle other than 90°, in order to account for the pitch of the roof The vertical face would mount flush with a bracket at a generally vertical orientation. This approach obviates the requirement to rotate the bracket to the desired pitch (to be discussed shortly), but does require custom fabrication of the zee purlins. This process is cumbersome and expensive, as special equipment located off the job site is often necessary to fabricate the purlins to the desired angle.

In other instances, a straight zee purlin is used and the bracket is rotated to pitch prior to fastening to the vertical post. This is considered the more conventional approach in the art and is illustrated in U.S. Pat. Nos. 6,240,682 and 6,470,644 (hereinafter collectively referred to as "James et al.").

Rotating and fastening the bracket to the post and purlin is considered one of the more challenging and time consuming aspects to such an installation. This requires the installer to measure the roof slope using an angle finder or similar device, rotating the roofing bracket to accommodate the slope, and fastening the bracket to the vertical post at the appropriate angle.

It is desirable in the art to make the installation of a roofing system more efficient without compromising the safety of the installers or the structural integrity of the roofing system.

SUMMARY

Various embodiments of the present invention are illustrated in the present disclosure. A first embodiment can be considered a roofing bracket to be coupled to a vertical post and a horizontal purlin of a roofing system whereby the horizontal purlin is positioned to support roof panels at a requisite pitch. The roofing bracket includes a reference brace and a clip. The reference brace includes a first brace face positioned planarly parallel with the vertical post and a second brace face extending at an angle angle from the first brace face and positioned planarly parallel with the vertical post. The clip includes a first clip face positioned to be fastened generally flush with the horizontal purlin and a second clip face extending at an angle from the first clip face and positioned to be fastened planarly parallel with the vertical post. The second clip face is coupled to the first brace face at a pivot point such that the clip can be rotated a particular angle relative to the reference brace. The angle of rotation being consistent with the requisite pitch of the roofing system.

A second embodiment may be construed as a roofing system that includes at least a first generally vertically extending structural member, at least a first generally horizontally extending structural member positioned to run perpendicular to the at least first vertical member, and a roofing bracket. The roofing bracket includes a brace positioned generally flush with two sides of the at least first vertical member. The roofing bracket also includes a clip that includes a first clip face positioned to be fastened to the at least first horizontal member and a second clip face extending at an angle from the first clip face and positioned to be fastened to the at least first vertical member. The second clip face is coupled to the brace at a pivot point such that the clip can be rotated a particular angle relative to the brace. The angle of rotation being consistent with the requisite pitch of the at least first horizontal member.

A third embodiment may be construed as a roofing bracket for connecting a generally horizontally and generally vertically extending structural member of a roofing structure together. The roofing bracket includes a first face adapted to be attached to the horizontal member and a second face extending at an angle from the first face and adapted to be attached to the vertical member. The second face comprises an integrated angle guide positioned such that an installer can determine an angle of rotation of the bracket by aligning a vertical edge of the vertical member with a desired angle reference in the integrated angle guide.

BRIEF DESCRIPTION OF THE DRAWINGS

The accompanying drawings incorporated in and forming a part of the specification, illustrate several aspects of the present invention, and together with the description serve to explain the principles of the invention.

DETAILED DESCRIPTION

In the following description, for purposes of explanation, numerous specific details are set forth in order to provide a thorough understanding of the present invention. It will be evident, however, to one skilled in the art that the present invention may be practiced without these specific details.

Figure 1:
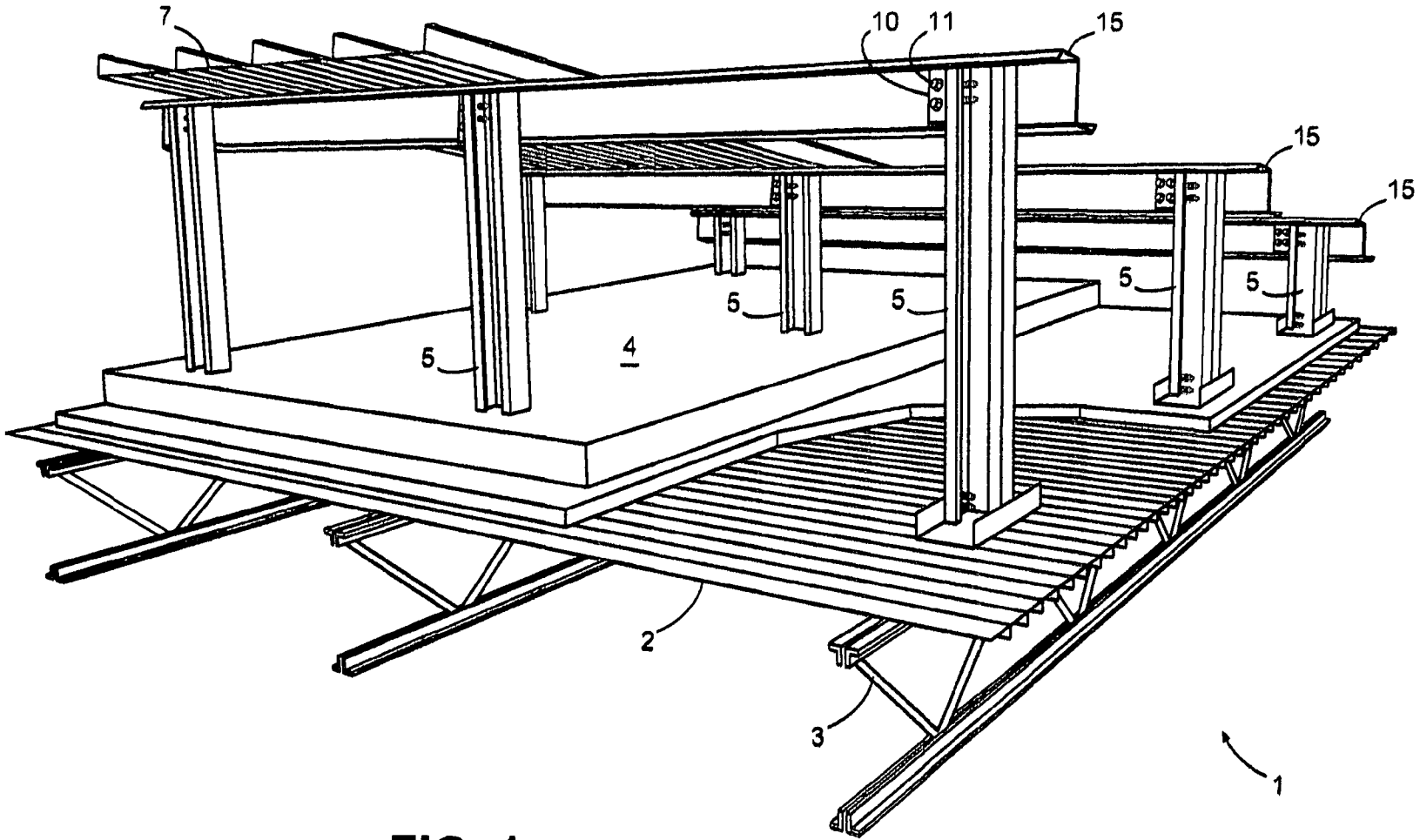
FIG. 1 (PRIOR ART)
FIG. 1 illustrates a conventional retro-fit roofing system.

Illustrated in FIG. 1 is a portion of a conventional retro-fit roofing system 1. Notably, the roofing system 1 makes use of conventional angle brackets 10 for attaching vertical support members, or posts 5, to horizontal support members, or purlins 15. A retro-fit roof is generally considered one that is built atop an existing roof structure. Most commonly, a retro-fit roofing system is built atop an existing flat roof, in order to provide a sloped, or pitched, roof Retro-fitting a new roof as opposed to replacing the existing roof is becoming ever more common for a variety of reasons. It should be noted that while the majority of the detailed description herein is with regard to a retro-fit roofing system, the embodiments of the present invention can be applied to any roofing system that requires their use.

Referring back to FIG. 1, a plurality of posts 5 are fastened to a surface of a roof substrate 2 using a base member 6 and optional bracket (not shown). Angle brackets 10 are used at upper locations of the vertical posts for anchoring a plurality of elongated purlins 15 to the vertical posts 5. Roof panels 7 are fastened flush to an upper surface of the purlins 15. The vertical posts 5 vary in height depending on the desired pitch of the roofing system 1. Likewise, the placements of the purlins 15, relative in height to the ground, vary according to the desired pitch of the roofing system 1. Due to the pitch or slope of the roof, the purlins 15 are not perfectly perpendicular to the posts 15. This requires slight rotation of the angle brackets 10 in order to meet the post 5 and the purlins 15 flush. The angle of rotation of the angle brackets 10 is consistent with the slope of the roof The roof substrate of FIG. 1 includes concrete or other refractory material 4. It will be appreciated that the drawings do not show every component that may be used in the roof substrate, or all variants of roof substrates, for the sake of clarity. In this illustration, a corrugated metal roof deck 2 disposed atop a steel bar joist system 3 comprises the existing roof The existing roof along with the concrete 4 or other refractory material 4, makes up the roof substrate.

The number and placement of the vertical posts 5 within the system 1 is a matter of design and generally based upon the structural requirements. Likewise, the placement of the purlins 15 are a matter of design.

Figure 2B:
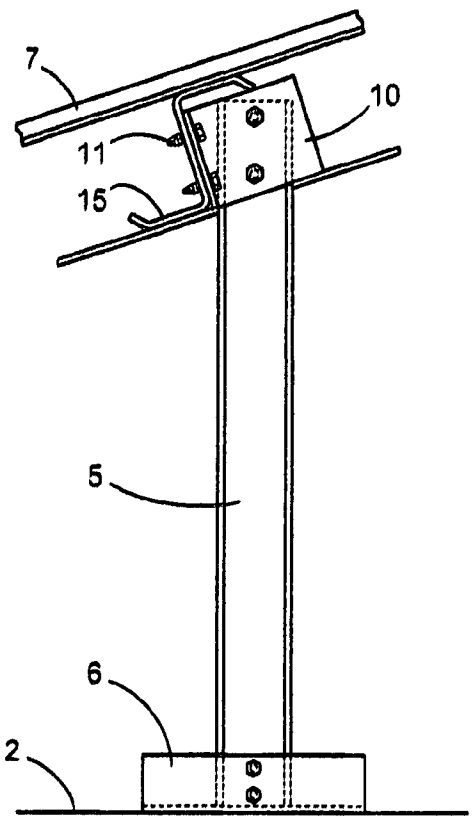
FIG. 2B (PRIOR ART)
FIGS. 2A-B are perspective and side views, respectively, of a conventional roofing clip.
Figure 2A:
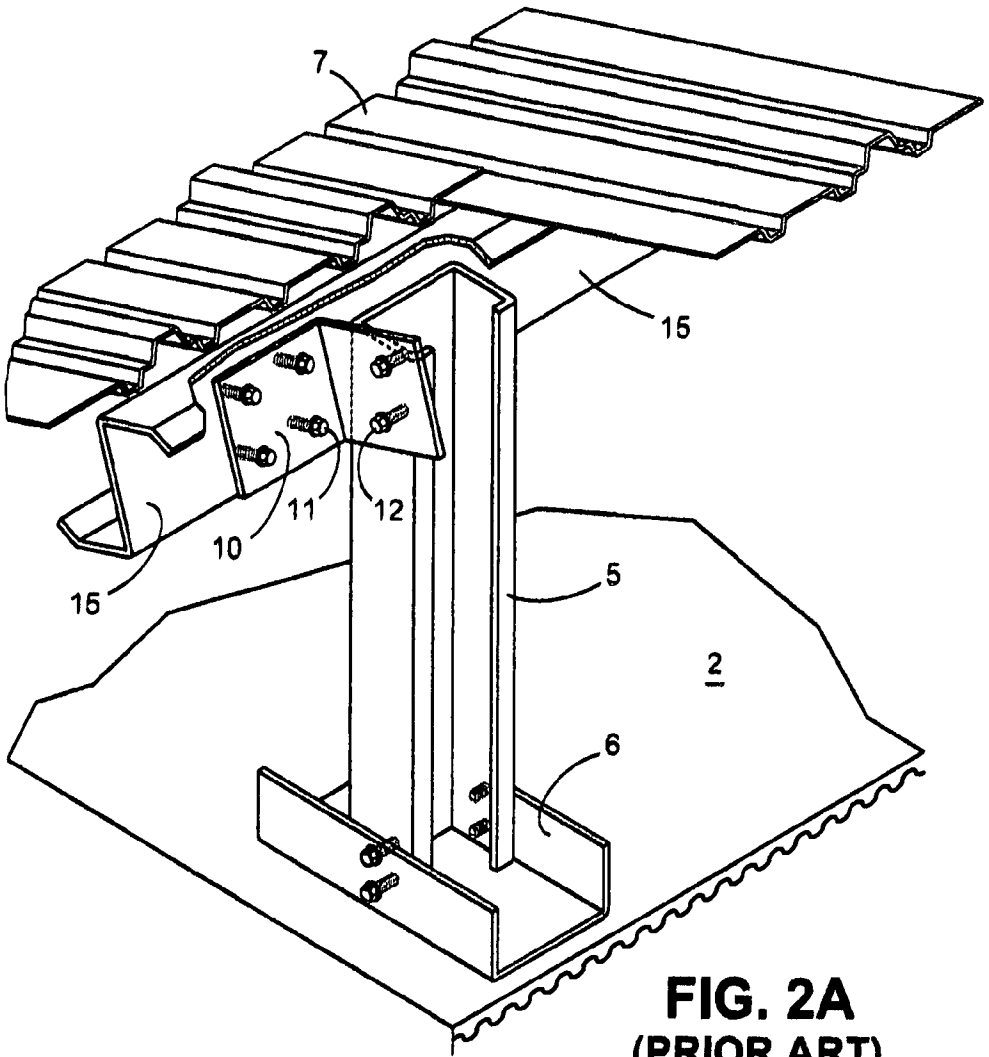
FIG. 2A (PRIOR ART)

FIGS. 2A-B provide further clarity to the relationship between vertical posts 5, horizontal purlins 15 (noting, however, that the purlins 15 are slightly rotated to accommodate the pitch of the roof), and angle brackets 10.

The vertical post 5 is often, but not necessarily, "C" shaped in cross section and manufactured of metal or metal alloy. The angle bracket 10 affixes to one side of the post 5 by way of fasteners 12, often self-puncturing. The vertical location of the placement of the bracket 10 to the post is a function of the design of the system 1.

The purlin 15 is often, but not necessarily, "Z" shaped in cross section (as best seen in FIG. 2B). The purlin 15 is comprised of a single piece of metal bent to form generally three faces—two horizontal and one vertical. The horizontal face (most notably the upper face) is for attaching the roof panels 7 thereto. The vertical face is for affixing the angle bracket 10 thereto. Angled lips may be found extending from the horizontal faces of the purlin 15.

As best illustrated in FIG. 2B, the angle bracket 10 is rotated to accommodate the desired pitch in the roof As such, the purlin 15, which is affixed to the bracket 10 via fasteners 11, is rotated. This provides for a network of purlins, positioned at the proper slope, for the roof panels 7 to be laid upon.

FIGS. 3A-5B illustrate multiple views of various embodiments of the present invention. The various embodiments are improvements upon the conventional roofing brackets known in the art and as illustrated in FIGS. 2A-B. Preferably the roofing brackets disclosed herein are composed of metal, preferably steel. Industry guidelines may call for certain standards with regard to size and shape, particularly gauge, in order to provide requisite structural integrity. These features of the bracket are considered beyond the scope of the present invention. The novel aspects and features of the various embodiments disclosed herein can be implemented within the guidelines required by the industry.

Figure 3A:
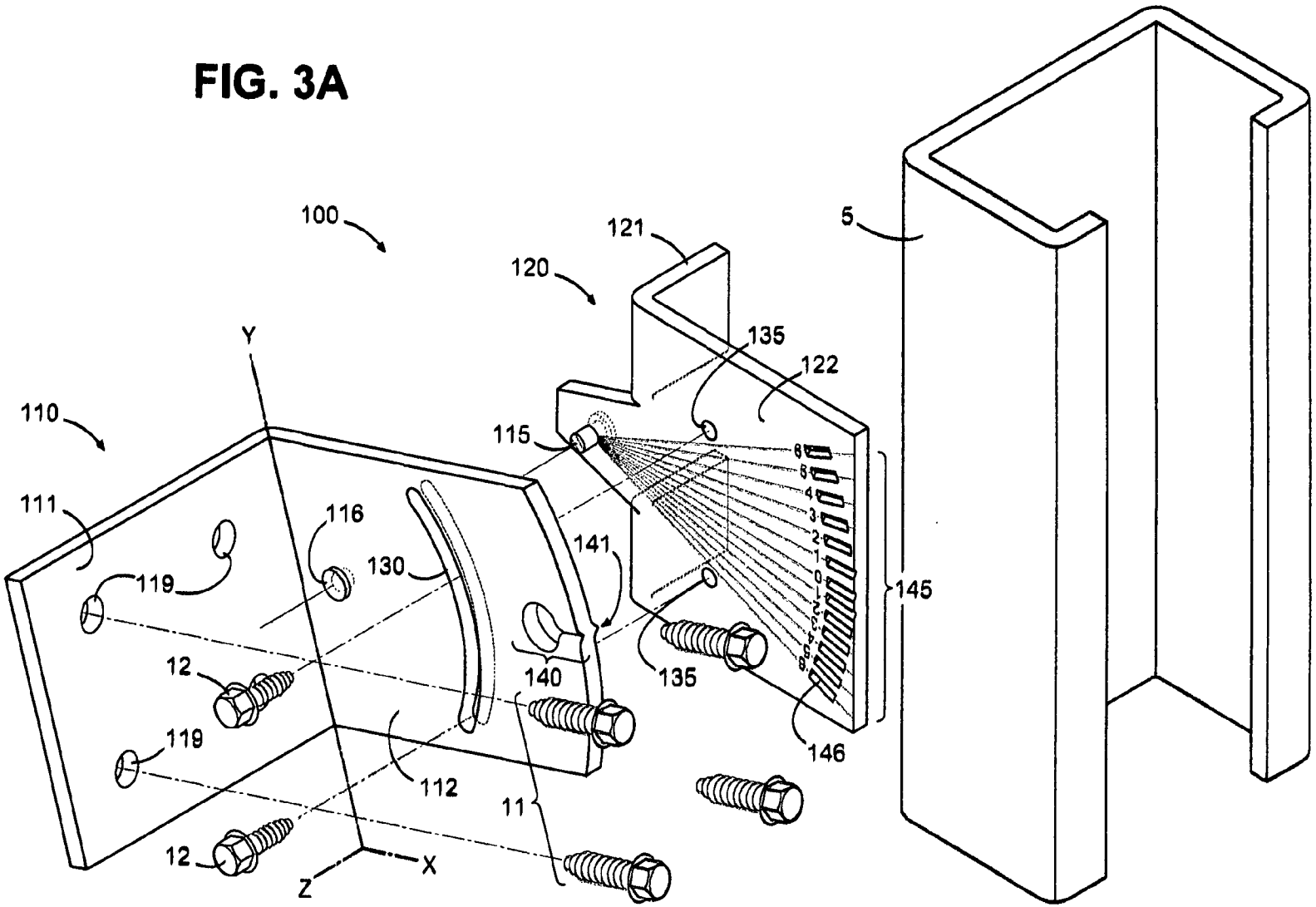
FIGS. 3A-B are exploded and perspective views, respectively, of a first embodiment of the present invention.
Figure 3B:
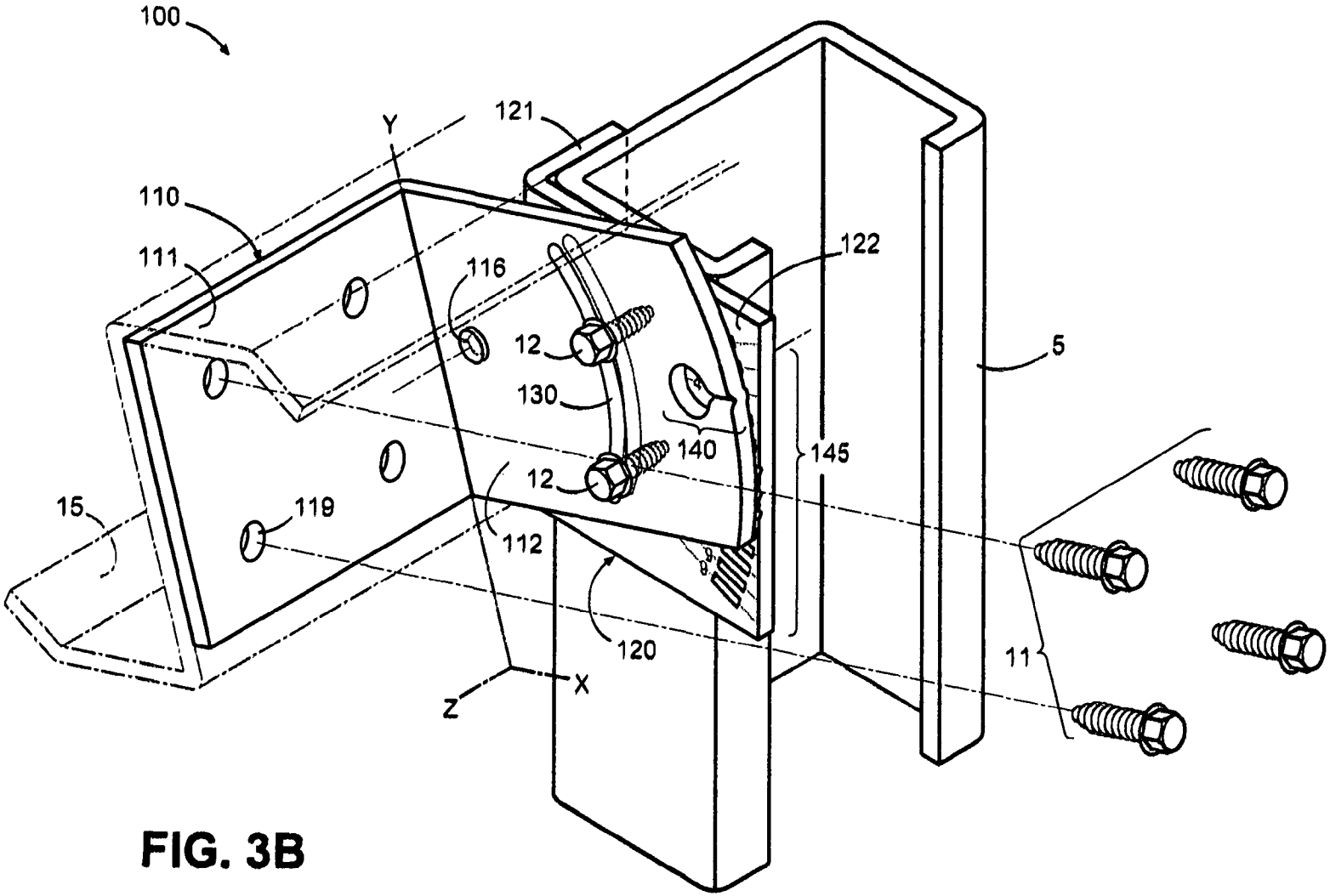

FIG. 3A is an exploded perspective view of a first embodiment of a roofing bracket 100. Bracket 100 is comprised of two pieces, a clip 110 and a brace 120, coupled together with a rivet 115. The rivet forms a pivot point from which the two pieces (110 and 120) can be rotated about each other.

The clip 110 is comprised of two faces that meet at a common edge, forming a 90° angle. A first face 111 is designed to attach to the purlin 15 of the roofing system 1 (see FIGS. 1-2). The second face 112 is designed to attach to the vertical post 5, thus creating the coupling of the purlin 15 to the post 5.

The first face 111 may include preformed holes 119 for receiving fasteners 11. The first face 111 would preferably mount flush to the vertical face of a "Z" purlin and fastened thereto with fasteners 11. The specific location of the network of preformed holes 119 is beyond the scope of the present invention. Alternatively, no holes may be preformed in the face 111. The specific dimensions of the first face 111 are beyond the scope of the present invention, however, the dimensions should suffice proper mounting to a purlin. A face 111 having dimensions of roughly 4"×4" is envisioned.

The second face 112 comprises a rivet hole 116 for receiving the rivet 115, a pre-cut radial slit 130, and an angle reference marker 140 with an integrated peep hole. The rivet hole 116 upon receiving the rivet 115 serves as a pivot point for which the clip 110 rotates relative to the brace 120. In this embodiment, the rivet hole 116 is positioned equidistant about the Y-axis, thus providing for symmetry in rotation. As will be illustrated in subsequent embodiments, the rivet hole 116 (and thus rivet 115 and pivot point) can be positioned in a number of locations along the second face 112.

The pre-cut radial slit 130 is shaped radially relative to the location of the pivot point and serves to receive fasteners 12. The exact position of the slit 130 is not critical but is such that the fasteners 12 are positioned meet the post 5 at roughly the center line. This provides for the greatest structural support.

The angle reference marker 140 is also positioned relative to the pivot point. In this embodiment it includes a reference line, a peep hole, and a protrusion 141 which is received by recesses in an angle guide 145 integrated in the brace 120. The reference marker is placed at the '0' angle.

The brace 120 is comprised of single piece of metal formed into two faces meeting at a generally 90° angle. The brace 120 is designed to sit flush against the post 5 and serve as a cleat in both the X and Z axes. When coupled to the clip 110 via the rivet 115, the brace 120 creates a reference edge perfectly perpendicular to the vertical edge of the post 5. The reference edge is thus used to form the proper angle of rotation to accommodate the pitch of the roof The first face 121 of the brace 120 is designed to sit flush against the post 5 and restrict movement in the X direction. In this embodiment, the first face 121 is comprised of bending the metal of the brace 120 to form two cleats.

The second face 122 is designed to sit flush against the post 5 and restrict movement in the Z direction. The second face 122 is positioned to sit between the second face 112 of the clip 110 and the post 5. The second face 122 includes an angle reference guide 145 and two preformed holes 135 for receiving fasteners 12.

The angle reference guide 145, in this embodiment, provides for six different angles in two directions. The six angles are consistent with the most widely used angles in roofing: 1:12 (~4.76°), 2:12 (~9.46°), 3:12 (~14.03°), 4:12 (~18.43°), 5:12 (~22.62°), and 6:12 (~26.57°). Certainly other angles could be implemented. The angle reference guide 145 is positioned relative to the rivet 115 and when combined with the reference marker 140 of the clip 110 can be used to determine the appropriate angle of rotation of the clip 110. At each angle on the reference guide 145 are dimples 146 for receiving the protrusion 141 found on the clip 110. While not necessary, this helps in locking the clip 110 into place at the desired angle.

The preformed holes 135 are positioned to align preferably with the center line of the face post 5 to which the bracket 100 will be attached. Notably, the radial slit 130 of the clip 110 is positioned to align the fasteners 12 with the preformed holes 135 of the brace 120.

In practice, an installer would mount the bracket 100 flush to the vertical post 5 at the desired height, using the brace 120 to cleat the bracket 100 into place. The installer would then rotate the clip 110 to the desired angle, using the reference marker 140 and reference guide 145 to help in determining the angle of rotation. Once rotated, the installer can drive fasteners 12 through the radial slit 130, through the preformed holes 135 and into the vertical post 5. The purlin 15 can then be fastened to the clip 110.

Figure 4A:
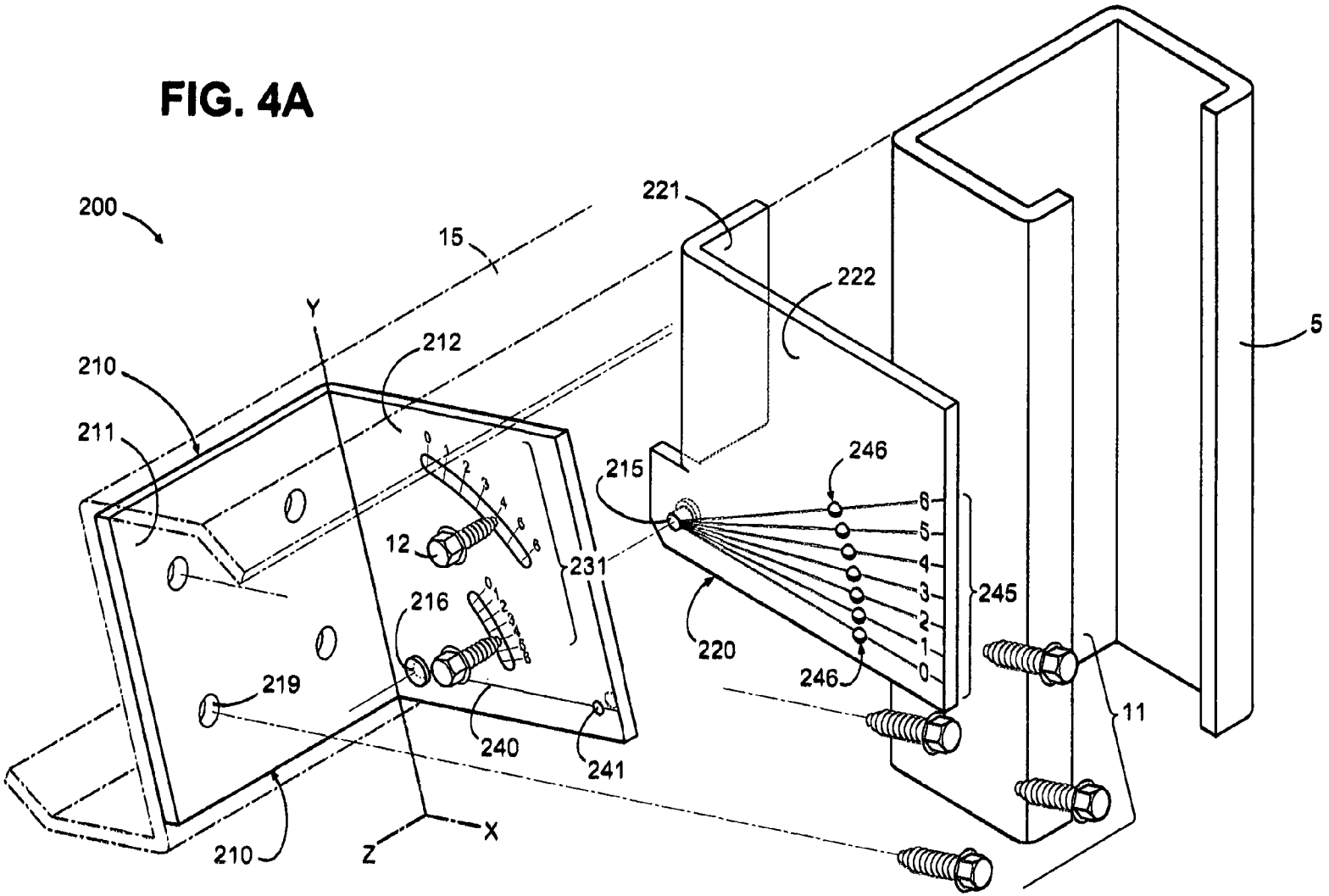
FIGS. 4A-B are exploded and perspective views, respectively, of a second embodiment of the present invention.
Figure 4B:
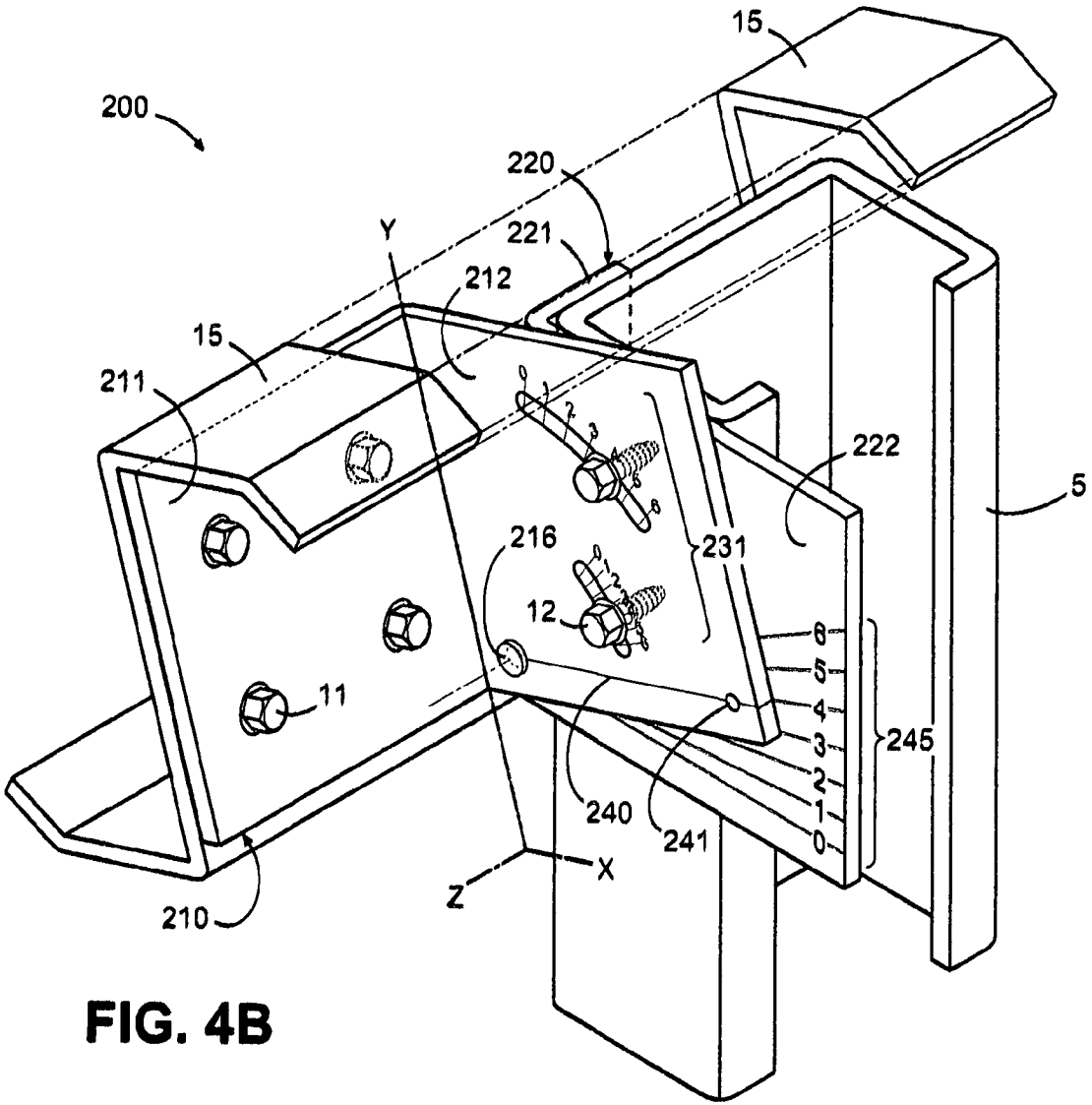

FIG. 4A-B illustrate a second embodiment of a roofing bracket 200 according to the present invention. Similar to the roofing bracket 100 of FIGS. 3A-B, roofing bracket 200 comprises two pieces: a clip 210 and brace 220. Two variations are provides to distinguish this embodiment from the previous embodiment.

First, the preformed radial slit 130 of the clip 110 is replaced with stamped radial guides 231. In this case, the slit is not actually cut and removed from the metal. In this embodiment, self-puncturing fasteners would be required.

Second, the pivot point, and thus rivet 215 and rivet hole 216 has been positioned in the lower left corner, as opposed to centered about the bracket 200 in the Y direction. The reference marker 240 and angle reference guide 220 is thus positioned relative to the pivot point. The stamped radial guides 231 are also positioned relative to the placement of the pivot point.

In practice, the bracket 200 functions similarly to the bracket 100. The above described variations eliminate the symmetry of the bracket, thus only providing usage on one side of the post 5. However, the bracket 200 does provide for greater range in rotation in cases where the pitch or slope is beyond 45°. The distinctions among the two embodiments illustrate the variety in the elements of the bracket.

Figure 5A:
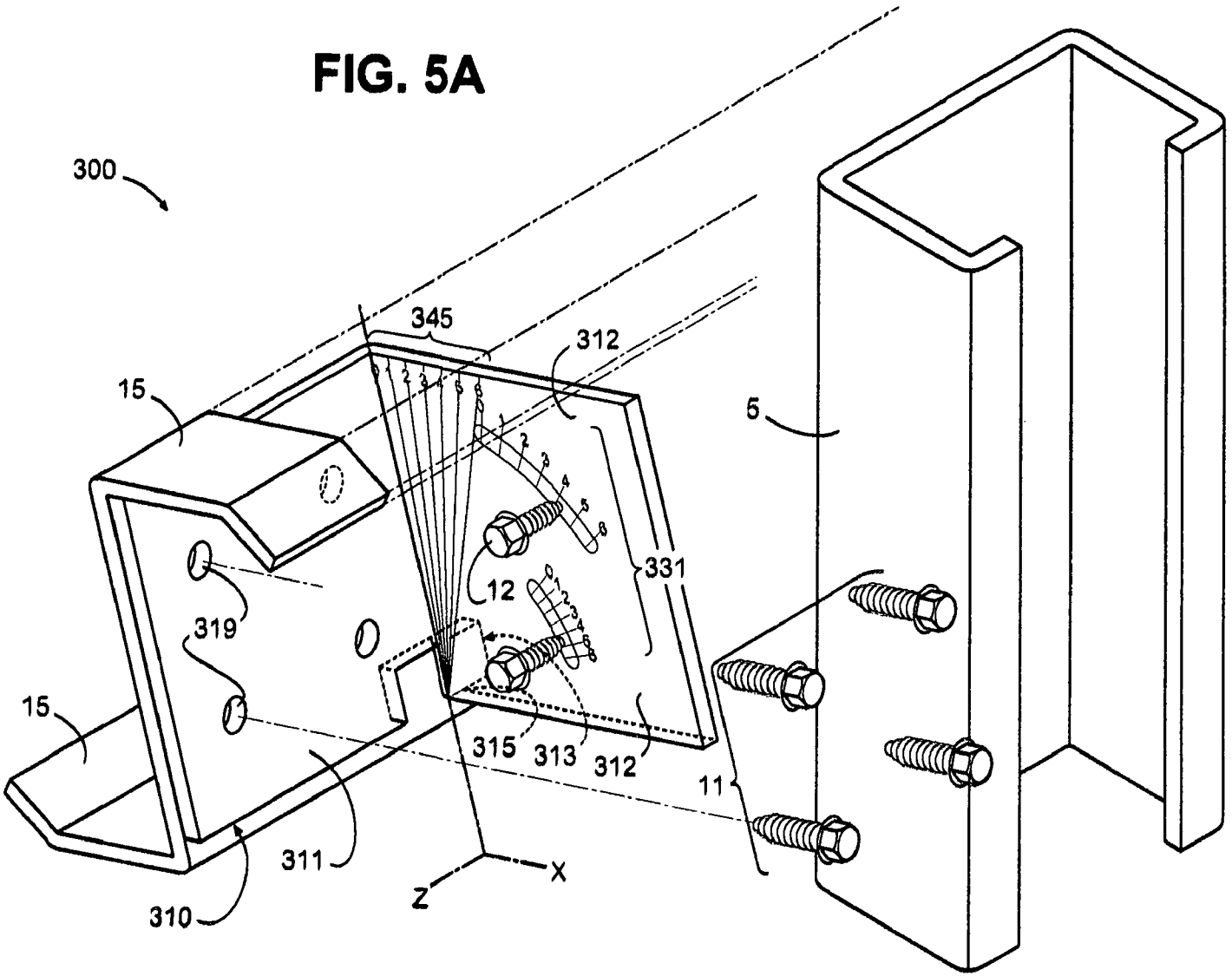
FIGS. 5A-B are exploded and perspective views, respectively, of a third embodiment of the present invention.
Figure 5B:
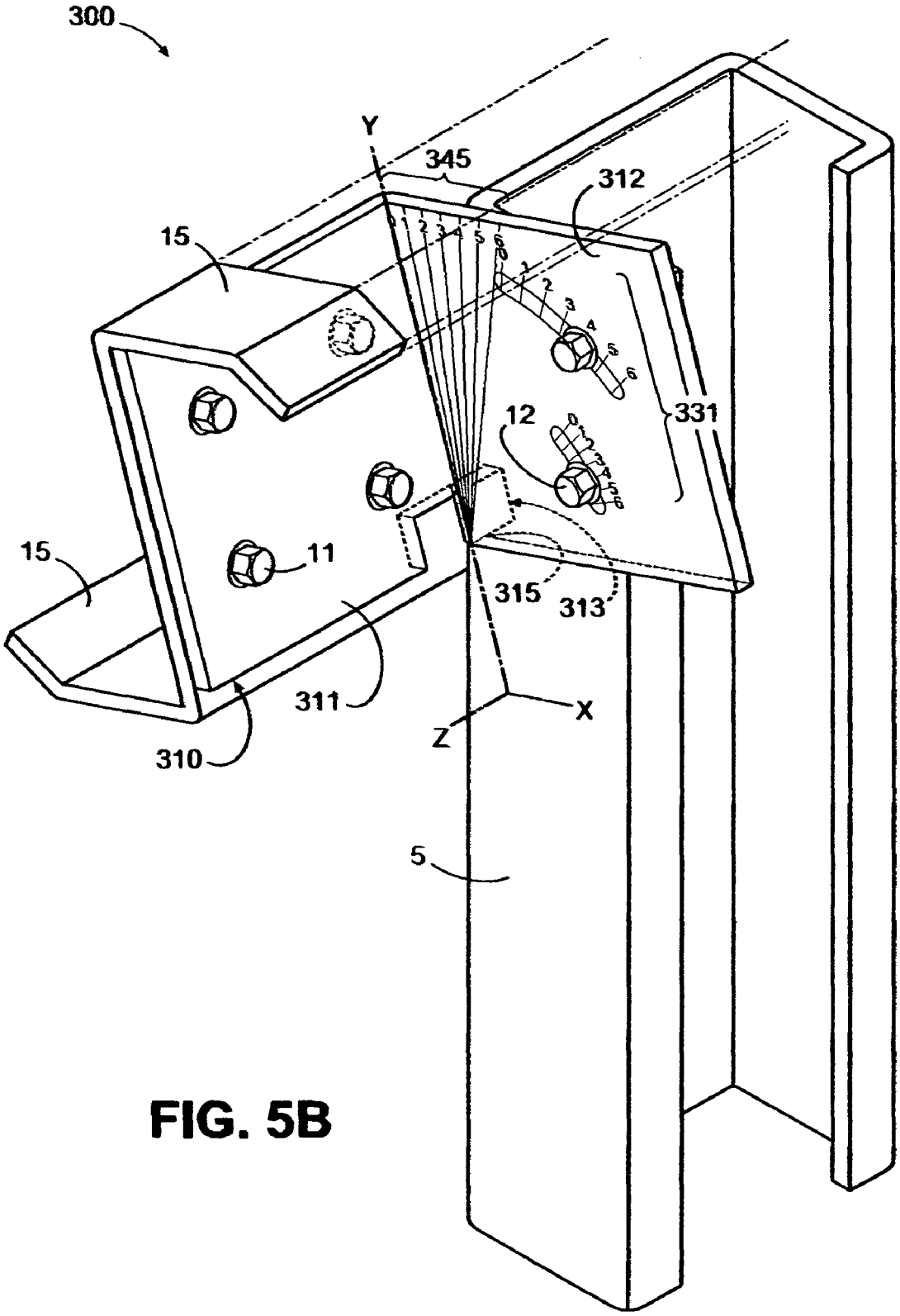

FIGS. 5A-B illustrate a third embodiment of a roofing bracket 300 in accordance with the present invention. This embodiment of the novel roofing bracket 300 is comprised of one single piece shaped to form three faces.

A first face 311 is positioned to mount flush with the vertical face of a purlin 15. As discussed with the other embodiments, the first face 310 may include a network of preformed holes 319 for receiving fasteners.

A second face 312 meets the first face 311 at a common edge to form, preferably, a 90° angle. The second face 312 is positioned to mount flush to a face of the vertical post 5. The second face 312 includes a stamped angle reference guide 345 and stamped radial fasteners guides 331. Alternatively, preformed radial slits for receiving fasteners could be incorporated.

A third face 313 is formed from a cutout of the first face 311 and meets the second face 312 at the common edge. The third face 313 is preferably formed at a 90° angle from the second face 312, thus planarly parallel to the first face 311. The third face 313 serves as a cleat and is designed to sit flush to the face of the vertical post 5.

When both the third face 313 and the second face 312 are positioned flush to the post 5, the common corner of the two faces (and bottom edge of the third face 313) serves as a pivot point from which the bracket 300 can be rotated to determine a proper angle. So long as the common corner and the second face 312 remain flush with the vertical post 5, an angle is created by the vertical edge of the post 5, the pivot point 315 serving as the apex, and the desired angle reference found on the guide 345. This angle of rotation is consistent with the desired pitch or slope of the roof.

In practice, an installer would position the bracket 300 flush against the post 5. The installer would then rotate the bracket 300 the appropriate angle by aligning the vertical edge of the post 5 with the desired angle marker in the guide 345. Once rotated, the installer can then adjust the bracket 300 in the Y direction to position the bracket 300 at the proper height. Once positioned, the installer can fasten the bracket 300 to the post using fasteners. The installer can then fasten the purlin 15 to the bracket 300.

Another embodiment could be envisioned as the bracket 300 without the third face 313 or cleat. In this case, the installer would align the vertical edge of the post 5 with the common corner 315 and the desired angle marker of the angle guide 345 to determine the desired angle of rotation. This embodiment does not, however, have the added resistance in the X direction that is provided for by the cleat 313.

The invention claimed is:

1. A roofing bracket to be coupled to a vertical post and a horizontal purlin of a roofing system whereby the horizontal purlin is positioned to support roof panels at a requisite pitch, said roofing bracket comprising:

a reference brace comprising:

a first brace face positioned planarly parallel with the vertical post, said first brace face comprising a plurality of preformed holes; and a second brace face extending at an angle from said first brace face and positioned planarly parallel with the vertical post; and a clip comprising:

a first clip face positioned to be fastened generally flush with the horizontal purlin; and a second clip face extending at an angle from said first clip face and positioned to be fastened planarly parallel with the vertical post, said second clip face coupled to said first brace face at a pivot point such that said clip can be rotated a particular angle relative to said reference brace, the angle being consistent with the requisite pitch of the roofing system, and wherein said second clip face comprises at least a first preformed radial slit positioned to receive at least a first fastener to fasten said clip to the vertical post via said preformed holes of said first brace face.

2. The roofing bracket of claim 1, wherein said first brace face comprises an angle guide and said second clip face comprises a reciprocal angle reference marker.

3. The roofing bracket of claim 2, wherein said first brace face comprises a plurality of female dimples or male protrusions positioned relative to each angle reference of said angle guide, and said second clip face comprises a reciprocating male protrusion or female dimple positioned relative to said reciprocal angle reference marker.

4. The roofing bracket of claim 1, wherein said second clip face comprises an angle guide and said first brace face comprises a reciprocal angle reference marker.

5. The roofing bracket of claim 4, wherein said second clip face comprises a plurality of female dimples or male protrusions positioned relative to each angle reference of said angle guide, and said first brace face comprises a reciprocating male protrusion or female dimple positioned relative to said reciprocal angle reference marker.

6. The roofing bracket of claim 1, wherein said second clip face further comprises at least a first integrated radial fastener guide for providing a suggested location for puncturing said second clip face with a fastener across a range of angles of rotation of said roofing bracket.

7. The roofing bracket of claim 6, wherein the at least first integrated radial fastener guide is positioned on said second clip face such that when applied the fastener is received at a generally vertical center line of the vertical post.

8. A roofing system comprising:

at least a first generally vertically extending structural member;

at least a first generally horizontally extending structural member positioned to run perpendicular to said at least first vertical member; and a roofing bracket, said roofing bracket comprising:

a brace positioned generally flush with two sides of said at least first vertical member;

a clip comprising:

a first clip face positioned to be fastened to said at least first horizontal member; and a second clip face extending at an angle from said first clip face and positioned to be fastened to said at least first vertical member, said second clip face coupled to said brace at a pivot point such that said clip can be rotated a particular angle relative to said brace, the angle being consistent with the requisite pitch of said at least first horizontal member, and wherein said second clip face comprises at least a first preformed radial slit positioned to receive fasteners to fasten said clip to said at least first vertical member.

9. The roofing system of claim 8, further comprising at least a first roof panel to be fastened atop said at least first horizontal member.

10. The roofing system of claim 8, wherein said brace comprises an angle guide and said second clip face comprises a reciprocal angle reference marker.

11. The roofing system of claim 8, wherein said second clip face comprises an angle guide and said brace comprises a reciprocal angle reference marker.

12. A roofing bracket for connecting a generally horizontally and generally vertically extending structural member of a roofing structure together, said roofing bracket comprising:

a first face adapted to be attached to the horizontal member; and a second face extending at an angle from said first face adapted to be attached to the vertical member, wherein said second face comprises an integrated angle guide positioned such that an installer can determine an angle of rotation of said bracket by aligning a vertical edge of the vertical member with a desired angle reference in said integrated angle guide, and wherein said second face further comprises at least a first preformed radial slit for receiving a fastener upon rotation of said roofing bracket.

13. The roofing bracket of claim 12, further comprising:

a third face extending at an angle from said second face and adapted to cleat against a vertical edge of the vertical member in order to prevent slippage of said roofing bracket upon rotation of said roofing bracket.

14. The roofing bracket of claim 12, wherein the at least first preformed radial slit is positioned on said second face such that when applied the fastener is received at a generally vertical center line of the vertical member.

15. The roofing bracket of claim 12, wherein said second face further comprises at least a first integrated radial fastener guide for providing a suggested location for puncturing said bracket with a fastener across a range of angles of rotation of said roofing bracket.

16. The roofing bracket of claim 15, wherein the at least first integrated radial fastener guide is positioned on said second face such that when applied the fastener is received at a generally vertical center line of the vertical member.

* * * * *